US010179337B2

(12) United States Patent
Lin et al.

(10) Patent No.: US 10,179,337 B2
(45) Date of Patent: Jan. 15, 2019

(54) MULTIFUNCTIONAL SHOWER HEAD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 23 days.

(21) Appl. No.: 15/270,665

(22) Filed: Sep. 20, 2016

(65) Prior Publication Data

US 2017/0120264 A1 May 4, 2017

(30) Foreign Application Priority Data

Nov. 2, 2015 (CN) ..... 2015 1 0732400

(51) Int. Cl.

| | |
|---|---|
| ***B05B 1/30*** | (2006.01) |
| ***B05B 15/65*** | (2018.01) |
| ***B05B 1/18*** | (2006.01) |
| ***B05B 12/00*** | (2018.01) |
| ***B05B 1/16*** | (2006.01) |

(52) U.S. Cl.

CPC ..... *B05B 1/3026* (2013.01); *B05B 1/1636* (2013.01); *B05B 1/18* (2013.01); *B05B 12/002* (2013.01); *B05B 15/65* (2018.02)

(58) Field of Classification Search

CPC ..... B05B 1/16; B05B 1/1627; B05B 1/1663; B05B 1/18; B05B 1/185; B05B 1/3026; B05B 1/3033; B05B 12/002; B05B 15/065

USPC ..... 239/443, 552–553.5, 556–568, 583; 251/237

See application file for complete search history.

(56) References Cited

U.S. PATENT DOCUMENTS

| | | | | |
|---|---|---|---|---|
| 5,433,384 | A * | 7/1995 | Chan | B05B 1/1636 239/239 |
| 2012/0305116 | A1* | 12/2012 | Zhou | B05B 1/1636 137/625.46 |
| 2017/0056896 | A1* | 3/2017 | Lei | B05B 1/12 |
| 2017/0100728 | A1* | 4/2017 | Gong | B05B 1/1636 |
| 2017/0136473 | A1* | 5/2017 | Yu | B05B 1/1636 |

* cited by examiner

*Primary Examiner* — Alexander Valvis
*Assistant Examiner* — Cody Lieuwen
(74) *Attorney, Agent, or Firm* — Rabin & Berdo, P.C.

(57) ABSTRACT

A multifunctional shower head includes a shower head main body including a high-volume water inlet and at least two outlets; a dial button; a switching fitting and a water stoppage fitting respectively linked to the dial button; a cyclic switch including a water diversion plate and water diversion body having at least two outlets; and a water stoppage switch including a water stoppage valve. When the dial button rotates in a first direction, the water stoppage fitting moves away from the water stoppage switch, and the switching fitting abuts against the cyclic switch thus switching to connect a different outlet of the water diversion body. When the dial button rotates in a second direction, the switching fitting moves away from the cyclic switch, and the water stoppage fitting abuts against the water stoppage switch thus closing the high-volume water inlet to achieve water stoppage.

11 Claims, 14 Drawing Sheets

MULTIFUNCTIONAL SHOWER HEAD

BACKGROUND OF THE INVENTION

1. Field of the Invention

The present invention relates to a shower head, especially to a multifunctional shower head.

2. Background of the Related Art

Traditional shower heads with multiple outlet functions mostly use a kind of button to switch the outlet function. When the button is operated, the outlet type of the shower head correspondingly changes. With the development of shower head structure and the function, a shower head that can achieve a low volume water output came out. This kind of shower head can achieve a low volume water stoppage when the user is applying shampoo or bath cream, compared to a full volume water stoppage of a traditional shower head. However, this kind of low volume water stoppage shower head still has a low volume of water flowing out when in a water-stop state. Therefore, the temperature of the shower space does not drop down quickly, it not only saves water, but also provides a nice experience to the user. However, this kind of water stoppage shower head needs an extra button to achieve the low volume water stoppage function, which makes the shower head structure complicated and not simple to use. The unclear operation thus increases the learning cost for the shower head.

SUMMARY OF THE INVENTION

The present invention solves the main technical problems of the existing technology and provides a multifunctional shower head. When the dial button is moved to one side, the outlet modes of the shower head are circularly switched. When the dial button is moved to the other side, the shower head is closed. When the water stoppage mode is switched to the water flowing mode, only a light force is needed and it has a good hand feel.

The technical proposal of the present invention follows.

A multifunctional shower head, comprises a shower head main body, a dial button component, a cyclic switching component and a water stoppage switching component. The dial button component comprises a dial button extending out of the shower head main body and a switching fitting element and a water stoppage fitting element linked to the dial button.

When the dial button is moved to one side, the water stoppage fitting element moves away from the water stoppage switching component and the switching fitting element to abut against the cyclic switching component, thus driving a water diversion plate of the cyclic switching component to rotate to change the relative position of the water diversion plate and the water diversion body, so that a different outlet of the water diversion body is connected to achieve waterway switching.

When the dial button is moved to another side, the switching fitting element moves away from the cyclic switching component and the water stoppage fitting element to abut against the water stoppage switching component, thus driving a water stoppage valve of the water stoppage switching component to close the inlet of the high-volume flow to achieve water stoppage.

The switching fitting element and the water stoppage fitting element are two independent parts, so that the water pressure due to water stoppage fully acts on the water stoppage fitting element and the water stoppage switching component.

In another preferred embodiment, the switching fitting element is a one-way driving pawl coaxially linked to the dial button.

In another preferred embodiment, the cyclic switching component is disposed with a driving pawl seat sleeved on the one-way driving pawl, and the internal periphery of the dial button is disposed with a protruding block fitting to the one-way driving pawl. When the dial button is moved to one side, the protruding block abuts against the one-way driving pawl to drive the one-way driving pawl to rotate. When the dial button is moved to another side, the protruding block rotates to move away from the one-way driving pawl, thus releasing the abutting and fitting relationship of the one-way driving pawl and the protruding block.

In another preferred embodiment, the cyclic switching component is further disposed with a one-way intermittent driving element. One end of the one-way intermittent rotating element is fixedly connected to the driving pawl seat, and the other end of the one-way intermittent rotating element is connected to the water diversion plate. The one-way intermittent driving element drives the water diversion plate to rotate intermittently one-way.

In another preferred embodiment, the one-way intermittent rotating element is disposed with a switching pawl and a ratchet wheel sleeved on the switching pawl. The internal periphery of the ratchet wheel is disposed with internal ratchets coupling to the switching pawl. When the switching pawl rotates towards the direction abutting against the internal ratchet, the ratchet wheel rotates a certain angle corresponding to the internal ratchet.

In another preferred embodiment, the external periphery of the ratchet wheel is further disposed with an external ratchet of equal size with that of the internal ratchet and opposite in direction. A stoppage pawl is configured to abut against the external ratchet.

In another preferred embodiment, the one-way intermittent rotating element further comprises a switching pawl seat to hold the switching pawl. The switching pawl seat is fixedly connected to a tension spring. When the switching pawl rotates towards the direction abutting against the internal ratchet, the tension spring is pulled.

In another preferred embodiment, the water stoppage fitting element is a cam coaxially linked to the dial button.

In another preferred embodiment, the water stoppage switching component comprises a rotating block. A side of the rotating block facing the cam is disposed with an inclined surface. When the dial button is moved towards the other side, the cam rotates towards the rotating block, so that the cam abuts against the inclined surface to drive the rotating block to rotate about the pivot of the rotating block. The rotating block rotates to abut against the water stoppage valve to make the water stoppage valve move from a first position to a second position, so that the high-volume flow inlet in the shower head main body is closed.

In another preferred embodiment, the water stoppage valve is disposed with a low volume inlet with a continuous water flow. A Y-shaped ring, i.e., a ring having a Y-shaped cross-section, is disposed between the valve body of the water stoppage valve and the internal wall of the shower head main body. When the Y-shaped ring is disposed to face the low volume water inlet, water flows to the shower head main body through the low volume water inlet to achieve low volume water stoppage. When the Y-shaped ring is disposed opposite to the low volume water inlet, water flow is stopped by the Y-shaped ring after flowing through the low volume water inlet to achieve water stoppage.

In another preferred embodiment, the water stoppage valve is connected to the reset spring. When the abutting of the cam and the rotating block is released, the reset spring drives the water stoppage valve to reset to the first position from the second position.

Compared to the existing known technology, the technical proposal of the present invention has advantages as follows.

1. The multifunctional shower head of the present invention is disposed with the button and the switching fitting element and the water stoppage fitting element linked to the dial button. When the dial button rotates to a different direction, one of the switching fitting element and the water stoppage fitting element works, so that one rotation of the dial button to a different direction can achieve two functions of outlet function switching and low volume water flow stoppage. Therefore, the switching fitting element and the water stoppage fitting element are independent, the two functions of outlet function switch and the water stoppage don't conflict, and the structure and the operation stability are better. As the switching fitting element and the water stoppage fitting element are disposed independently, when in the water stoppage mode, only the water stoppage fitting element is pressed by the water pressure, and the switching fitting element is not influenced. Therefore, when switched from the water stoppage mode to the water flowing mode, only a small force is needed to switch the switching fitting element and the operating hand feel is better.

2. The multifunctional shower head of the present invention provides that the cyclic switching component coupled to the switching fitting element further disposed with a one-way intermittent rotating element. This makes the water diversion plate rotate by a fixed angle each time with the coupling of the driving pawl and the internal ratchet of the ratchet wheel, so that the user can feel a specific gearing when switching the outlet. This provides a good hand feeling and accurate operating.

3. The multifunctional shower head of the present invention provides that the one-way intermittent rotating element further comprises a stoppage pawl abutting fitting to the external ratchet of the ratchet wheel. The external ratchet has an opposite direction to the internal ratchet so that, when the driving pawl is coupled to the internal ratchet of the ratchet wheel, it needs to overcome the abutting force of the stoppage pawl and the external ratchet of the ratchet wheel. This improves the hand feeling. When the ratchet wheel rotates in an angle corresponding to one internal ratchet, the stoppage pawl moves away from the external ratchet and resets to abut against the next external ratchet in the rotating direction of the ratchet wheel. Therefore, the stoppage pawl and the external ratchet reset to abut against each other after the user rotates the dial button once. This prevents the ratchet wheel from drawing back when the switching pawl rotates backwardly. This makes the gearing feel more specific.

4. The multifunctional shower head of the present invention provides that, the driving pawl resets automatically under the action of the tension spring when the user releases the dial button, so that the dial button is always in the initial position when the user operates the dial button. This makes the operation convenient and smooth.

5. The multifunctional shower head of the present invention provides that, as the low volume water outlet is disposed in the water stoppage valve in a running through manner, whether the water stoppage valve is in the first position or the second position, as the low volume water outlet connects the two sides of the water stoppage valve, the water pressure difference of two sides of the water stoppage valve is significantly reduced. Thus, the user only needs to overcome the elastic force of the reset spring, thus ensuring the water stoppage operating hand feel.

6. The multifunctional shower head of the present invention provides that, a Y-shaped ring is disposed between the water stoppage valve and the shower head main body. When the Y-shaped ring is disposed to face the low volume water inlet, water flows to the shower head main body through the low volume water inlet to achieve low volume water stoppage. When the Y-shaped ring is disposed opposite to the low volume water inlet, water is stopped by the Y-shaped ring after flowing through the low volume water inlet to achieve full water stoppage. Therefore, full water stoppage or low volume water stoppage may be chosen by adjusting the direction of the Y-shaped ring.

BRIEF DESCRIPTION OF THE DRAWINGS

FIG. 11-1 is an exploded view of FIG. 11.

FIG. 12 illustrates a sectional diagram of the shower head of the embodiment of the present invention in full water stoppage state when the dial button rotates in the counter-clockwise direction; and.

FIG. 12-1 is an exploded view of FIG. 12.

DETAILED DESCRIPTION OF THE EMBODIMENTS

The present invention will be further described with drawings and the embodiments.

Figure 1:
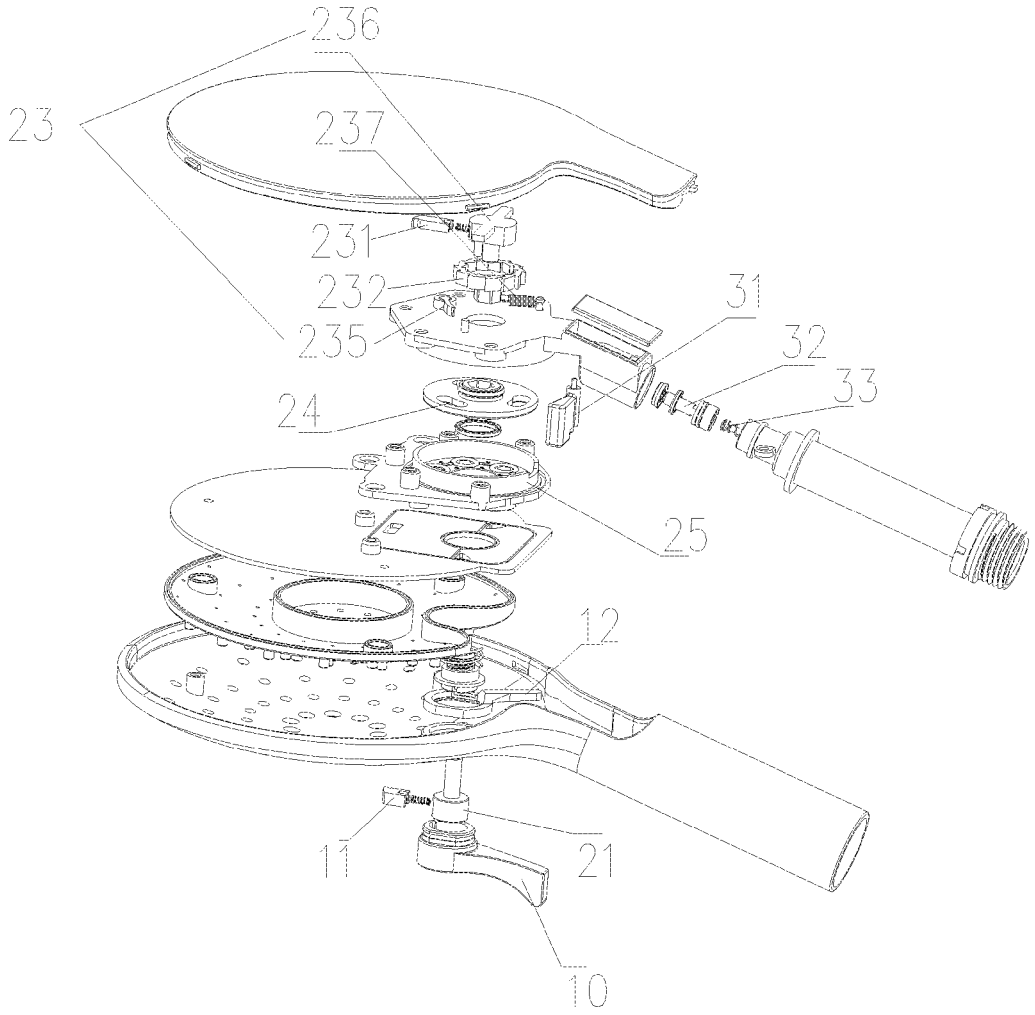
FIG. 1 illustrates an exploded and schematic diagram of a preferred embodiment of the present invention.
Figure 2:
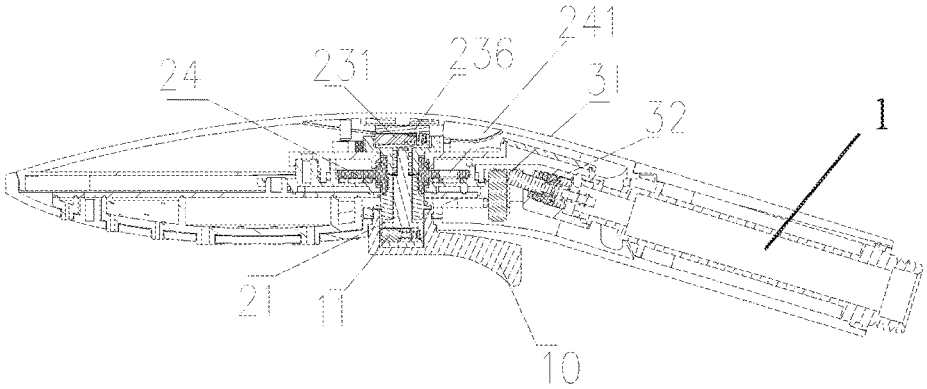
FIG. 2 illustrates a sectional diagram of the embodiment of the present invention.
Figure 3:
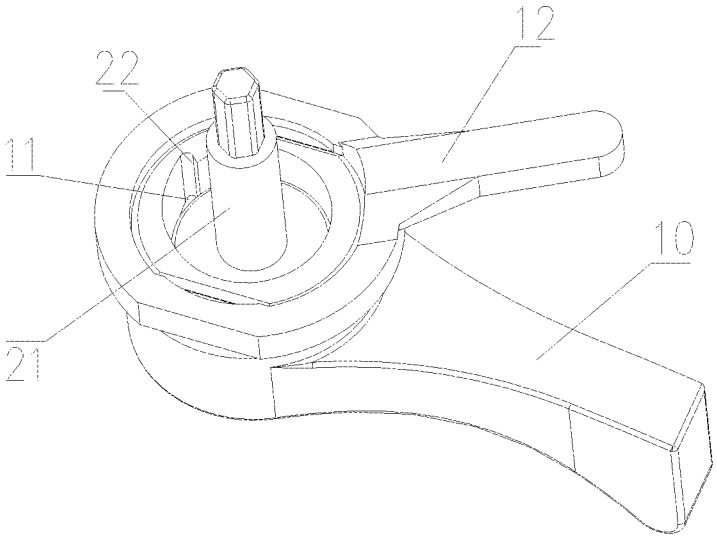
FIG. 3 illustrates a schematic diagram of the dial button component of the embodiment of the present invention.
Figure 4:
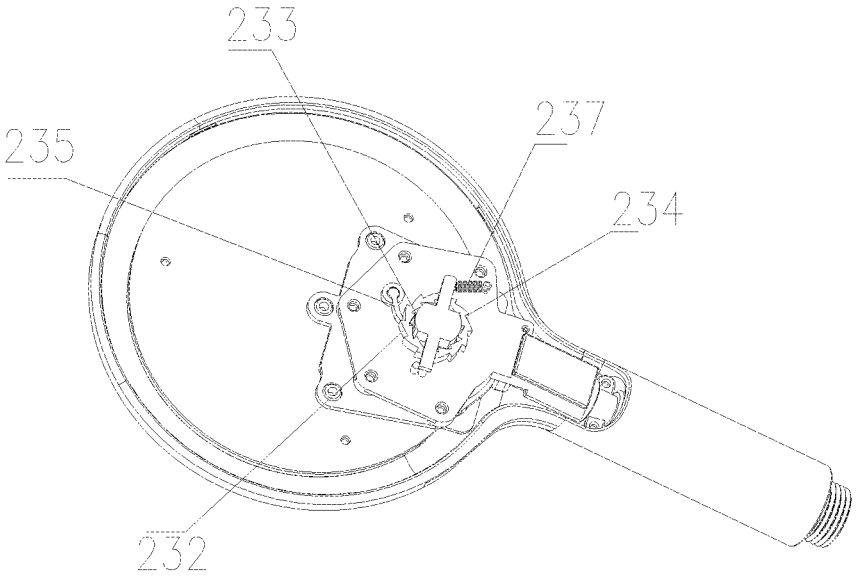
FIG. 4 illustrates a schematic diagram of the one-way intermittent rotating element of the embodiment of the present invention.
Figure 5:
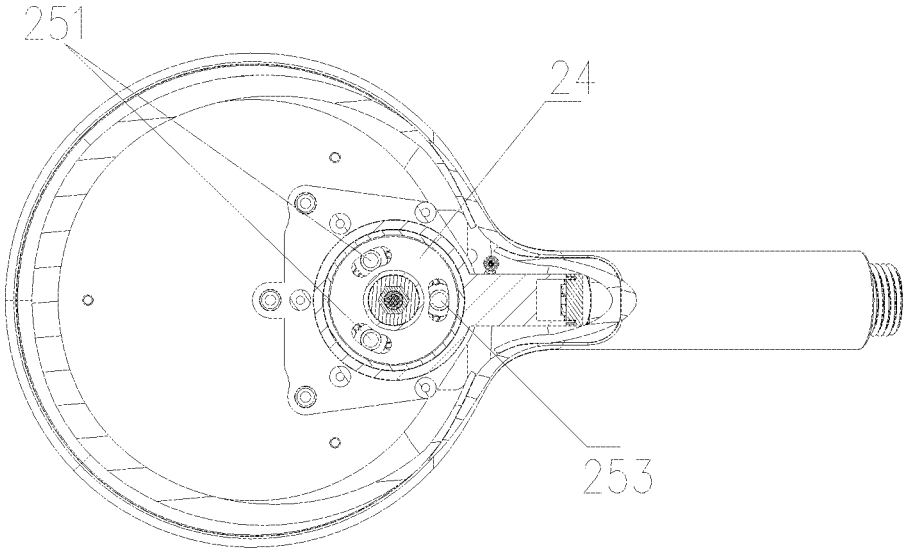
FIG. 5 illustrates a sectional diagram of the shower head with of the embodiment of the present invention with the indication of the position of the water diversion plate when the outlet function is inner ring water.
Figure 6:
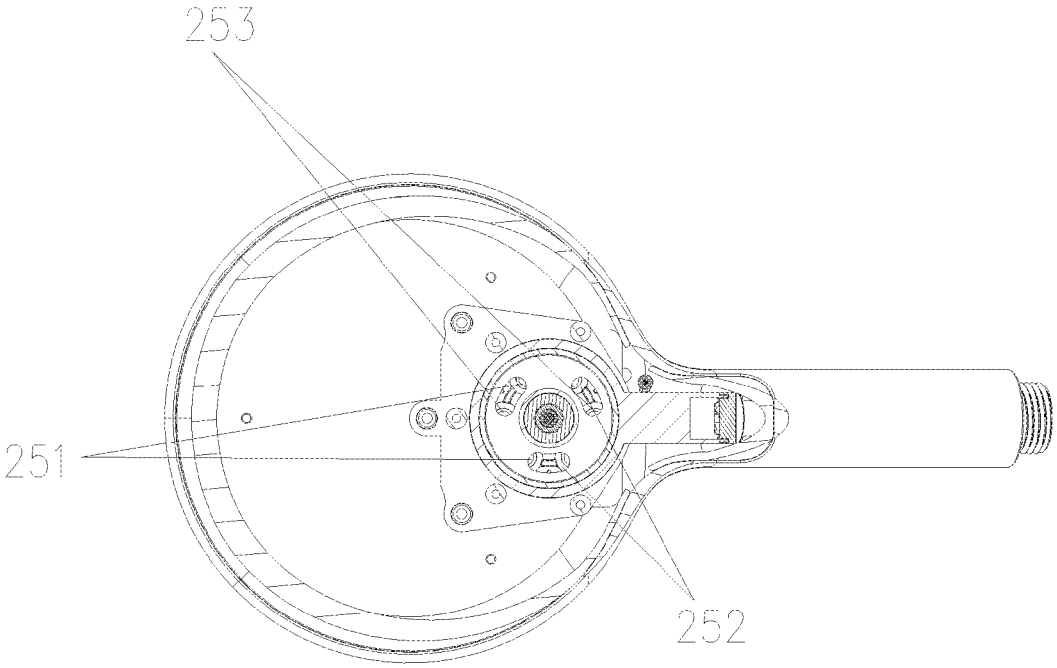
FIG. 6 illustrates a sectional diagram of the shower head of the embodiment of the present invention with the indication of the position of the water diversion plate when the outlet function is mixing water.
Figure 7:
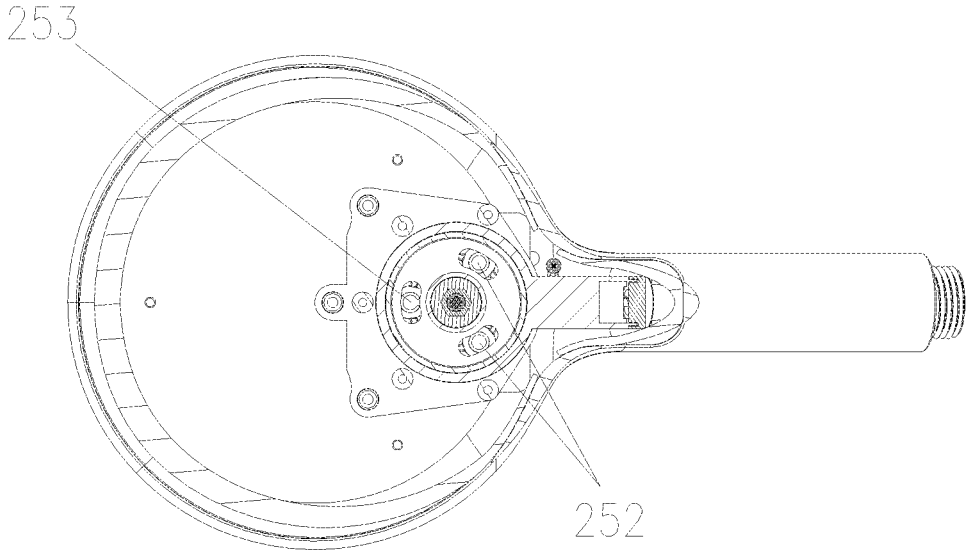
FIG. 7 illustrates a sectional diagram of the shower head of the embodiment of the present invention with the indication of the position of the water diversion plate when the outlet function is outer ring water.
Figure 8:
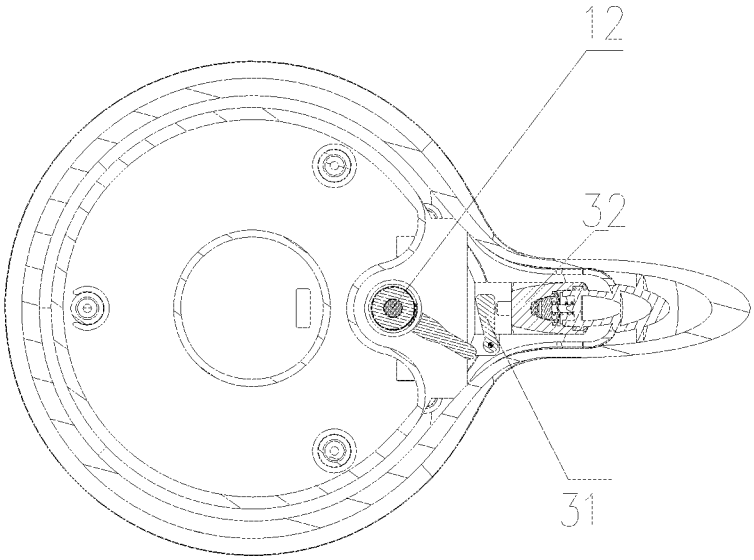
FIG. 8 illustrates a sectional diagram of the shower head of the embodiment of the present invention with the indication of the position of the cam and the rotating block when the dial button is situated in the initial position.
Figure 9:
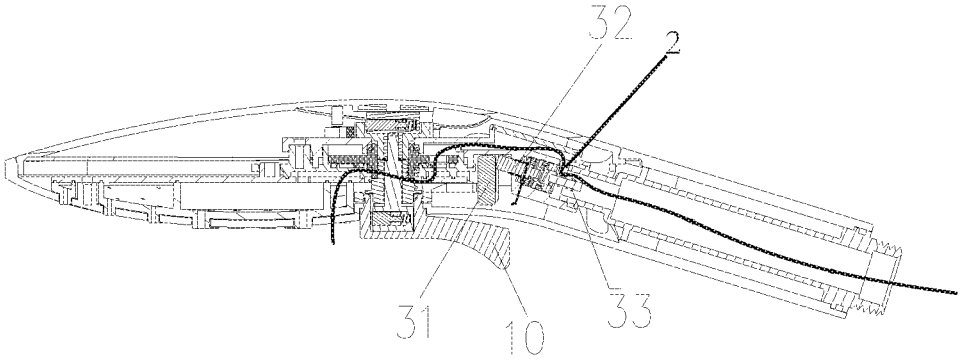
FIG. 9 illustrates a sectional diagram of the shower head of the embodiment of the present invention with the indication of the water flowing state when the dial button is situated in the initial position.
Figure 10:
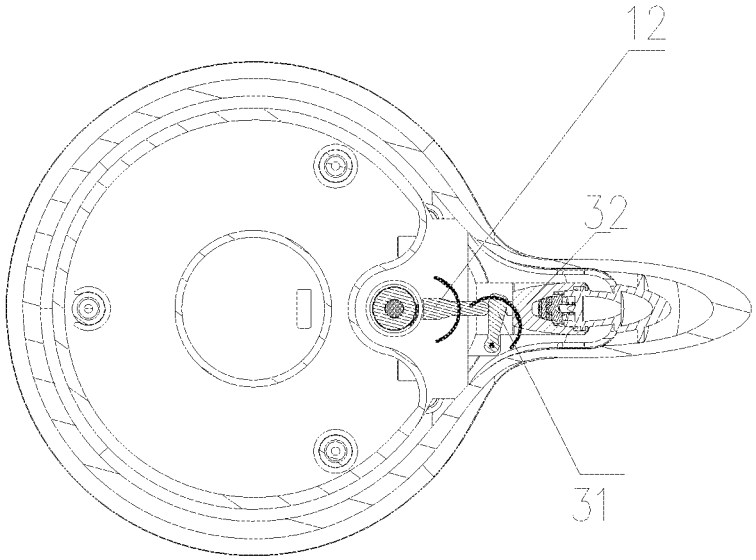
FIG. 10 illustrates a sectional diagram of the shower head of the embodiment of the present invention with position of the cam and the rotating block when the dial button rotates in the counter-clockwise direction.
Figure 11:
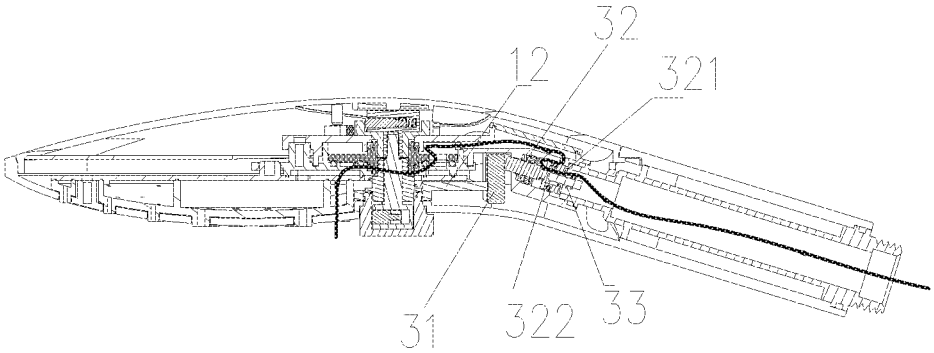
FIG. 11 illustrates a sectional diagram of the shower head of the embodiment of the present invention in low volume water stoppage state when the dial button rotates in the counter-clockwise direction.
Figures 1, 11:
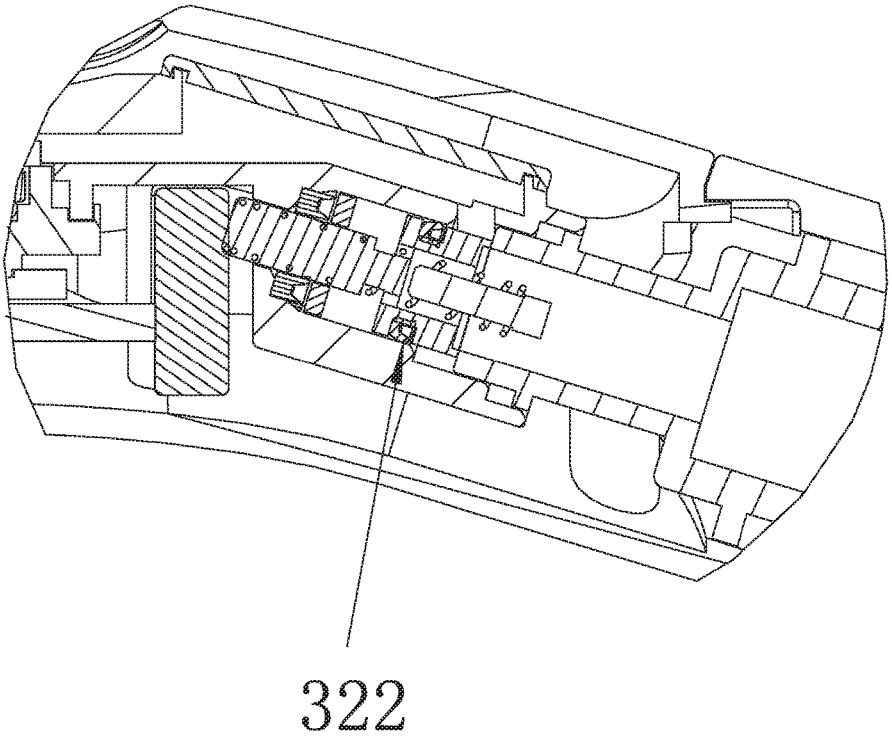
Figure 12:
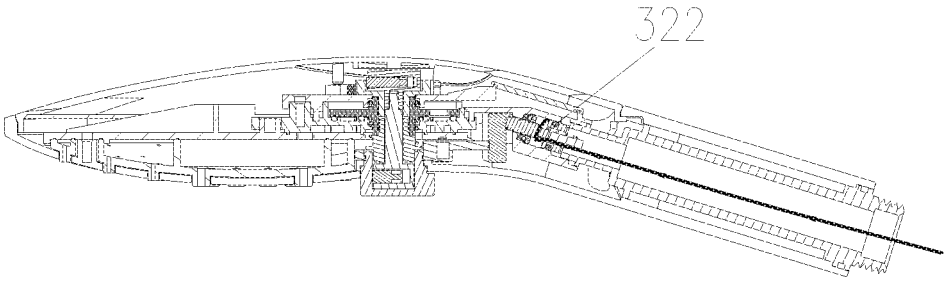
Figures 1, 12:
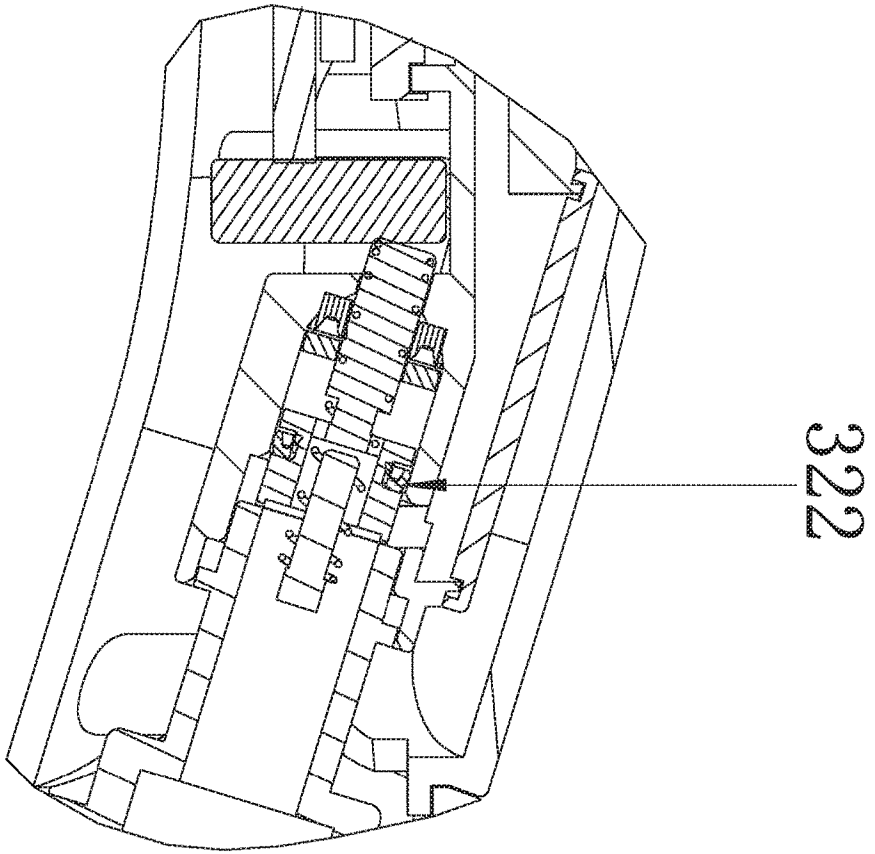

Referring to FIGS. 1 to 12, a multifunctional shower head with dial button comprises a shower head main body 1, a dial button component, a cyclic switching component and a water stoppage switching component. The dial button component comprises a dial button 10 extending out of the shower head main body 1, a switching fitting element linked to the dial button and a water stoppage fitting element. The switching fitting element is a one-way driving pawl coaxially linked to the dial button 10.

The cyclic switching component is disposed with a driving pawl seat 21 sleeved on the one-way driving pawl 11 and the internal periphery of the dial button 10 is disposed with a protruding block 22 fitting to the one-way driving pawl 11. When the dial button 10 is situated in the central portion, the protruding block 22 abuts against the one-way driving pawl 11. When the dial button 10 moves in the clockwise direction, with the action of the abutting force, the protruding block 22 drives the one-way driving pawl 11 to rotate so as to drive the driving pawl seat 21 to coaxially rotate. When the dial button 10 moves in the counter-clockwise direction, the protruding block 22 moves away from the one-way driving pawl 11 to unfreeze the abutting of the one-way driving pawl 11 and the protruding block 22. Therefore, only when the dial button 10 rotates in the clockwise direction, is the ratchet seat 21 linked to the dial button. When the dial button 10 rotates in the counter-clockwise direction, the ratchet seat 21 remains still.

The cyclic switching component is further disposed with a one-way intermittent rotating element 23. One end of the one-way intermittent rotating element 23 is fixedly connected to the driving pawl seat 21 and the other end is connected to the water diversion plate 24. Because one end of the one-way intermittent rotating element 23 is fixedly connected to the driving pawl seat 21, when the dial button 10 rotates in the clockwise direction, the one-way intermittent rotating element 23 rotates synchronously so as to drive the water diversion plate to achieve one-way intermittent rotating. With the rotating of the water diversion plate 21, the relative position of the water diversion plate 21 and the water diversion body changes, the through hole 241 of the water diversion plate is connected to a different outlet of the water diversion body, so that it can achieve different outlet effects. In this embodiment, the water diversion body 24 has two inner ring outlets 251, two outer ring outlets 252 and two blind holes 253. When the through hole 241 of the water diversion plate 24 is connected to the inner ring outlets 251, the outlet function is inner ring water. When the through hole 241 of the water diversion plate 24 is connected to the outer ring outlets 252, the outlet function is outer ring water. When the through hole 241 of the water diversion plate 24 is respectively connected to the inner ring outlets 251 and to the outer ring outlets 252, the outlet function is mixture water. Therefore, by rotating the dial button 10 in the clockwise direction, the outlet functions are cyclically switched.

The one-way intermittent rotating element 23 is disposed with a switching pawl 231 and a ratchet wheel 232 sleeved on the switching pawl 231. The internal periphery of ratchet wheel 232 is disposed with internal ratchets 233 that couple to the switching pawl 231. When the ratchet seat 21 rotates in the clockwise direction, the switching pawl 231 is driven to rotate towards a direction to abut against the internal ratchet, so that an abutting force is generated to drive the ratchet wheel 232 to rotate. When the ratchet wheel 232 rotates in an angle corresponding to one internal ratchet 233, the switching pawl 231 abuts against the next internal ratchet 233 in the rotating direction. Therefore, the ratchet wheel can intermittently rotate, each rotating angle being fixed, so that the user can feel a specific gearing when switching outlets. The device also has a good hand feel and accurate operation.

To further improve the hand feel when the user cyclically switches the outlet functions, the external periphery of the ratchet wheel 232 is further disposed with an external ratchet 234 having an equal size with that of the internal ratchet 233 and an opposite direction. A stoppage pawl 235 is configured to abut against the external ratchet 234. When the ratchet wheel 232 rotates in the clockwise direction, the stoppage pawl 235 moves in a direction away from the ratchet wheel 232 as with the abutting force between the stoppage pawl 235 and the external ratchet 234. When the ratchet wheel 232 rotates in an angle corresponding to one internal ratchet 233, the stoppage pawl 235 resets and abuts against the next external ratchet 234 in the rotating direction of the ratchet wheel. Therefore, when the driving pawl 231 is coupled to the internal ratchet 233 of the ratchet wheel 232, it needs to overcome the abutting force between the stoppage pawl 235 and the external ratchet 234 of the ratchet wheel 232 so as to improve the hand feel. When the ratchet wheel 232 rotates in an angle corresponding to one internal ratchet 233, the stoppage pawl 235 moves away from the external ratchet 234 and resets to abut against the next external ratchet 234 in the rotating direction of the ratchet wheel 232. Therefore, the stoppage pawl 235 and the external ratchet 234 reset to abut against each other after the user rotates the dial button once. This prevents the ratchet wheel 232 from drawing back when the switching pawl 231 rotates backwardly and thus makes the gearing feel more specific.

If the user rotates the dial button 10 to switch a gear and the dial button then stops in the rotated position, the dial button would be situated in a different position each time the user switches the outlet function. This goes against skillful operation by the user. When the dial button is in a different position, the gesture to rotate the dial button 10 is different which makes it uncomfortable. To eliminate this negative factor, the one-way intermittent rotating element 23 further comprises a switching pawl seat 236 to hold the switching pawl 231 and the switching pawl seat 236 is fixedly connected to a tension spring 237. Thus, when the user releases the force to the dial button 10, the switching pawl seat 236 drives the switching pawl 231 to reset under the action of the reset force of the tension spring 237, so that the ratchet seat 21 drives the dial button 10 to reset. Therefore, each time after the user rotates the dial button to switch the gear, the dial button resets to the initial position, so that the user uses the same force to switch the gear and the gesture is similar.

The water stoppage fitting element is a cam 12 coaxially linked to the dial button 10.

The water stoppage switching component comprises a rotating block 31. When the dial button 10 moves in the counter-clockwise direction, the cam 12 rotates towards the rotating block 31, the side of the rotating block 31 that faces the cam 12 is disposed with an inclined surface coupled to the cam 12. When the cam 12 abuts against the rotating block 31, the abutting force makes the rotating block 31 rotate about its pivot. Then, the rotating block 31 rotates to abut against the water stoppage valve 32 to make the water stoppage valve 32 move from the first position to the second position, so that a high-volume water inlet 2 in the shower head main body 1 is closed to achieve water stoppage.

In this embodiment, the water stoppage has two modes: a low volume water stoppage and a full water stoppage. The detailed structure follows.

A low volume water inlet 321 is disposed in the water stoppage valve 32 to keep water flowing. A Y-shaped ring 322 is disposed between the water stoppage valve 32 and the shower head main body 1.

When the Y-shaped ring 322 is disposed to face the low volume water inlet 321, if the water stoppage valve 32 is in the second position, water flows to the shower head main body 1 out of the outlet from the Y-shaped ring 322 through the low volume water inlet 321 to achieve low volume water stoppage.

When the Y-shaped ring 322 is disposed opposite the low volume water inlet 321, if the water stoppage valve 32 is in the second position, water is stopped by the Y-shaped ring 322 after flowing through the low volume water inlet 321 to achieve water stoppage. Since water can't flow to the inner side of the shower head main body 1, full water stoppage is achieved.

When dial button 10 rotates in the counter-clockwise direction, the shower head main body 1 achieves low volume water stoppage or full water stoppage. Thus, conveniently, one just needs to adjust the direction of the Y-shaped ring to switch the two water stoppage modes. The water stoppage modes are suitable when the user needs to close the shower water for a short time, such as when applying shampoo or bath cream.

Since the rotating block 31 and the cam 12 are coupled in an inclined surface abutting way, even when the user releases button 10, abutting and coupling also exist so that the dial button 10 does not reset automatically. When the user needs a low volume water stoppage or a full water stoppage, the user only needs to rotate the dial button in a counter-clockwise direction to release the dial button. A prolonged pushing of the dial button is not required.

In this embodiment, the water stoppage valve 32 is connected to the reset spring. When the user dials the dial button to the initial position, the abutting coupling between the cam 12 and the rotating block 31 is released and the reset spring 33 drives the water stoppage valve 32 to the first position from the second position. Therefore, this completes the process of returning the shower head from a low volume water stoppage or a full water stoppage to a normal outlet.

As can be seen from the above, when in full water stoppage, water flow is closed by the water stoppage valve 32, and the water pressure works on the water stoppage valve 32, the cam 12 and the rotating block 31. Since the switching fitting element and these components are independent, when in the full water stoppage state, the switching fitting element isn't influenced by the water pressure. When in low volume water stoppage, although there is a low volume of water flowing to the shower head main body 1, the water is flowing out of the outlet of the shower head main body 1. The switching fitting element is not influenced by the water pressure so that there is no need to overcome the water pressure when the user dials the dial button 10 from the water stoppage position to the initial position. This significantly reduces the force needed thus ensuring the operating hand feel.

Moreover, since the low volume outlet 321 is disposed in the water stoppage valve 32 in a running through manner, when the water stoppage valve 32 is in the first position, the low volume water outlet 321 connects to two sides of the water stoppage valve so that the water pressure difference of the two sides of the water stoppage valve 32 is significantly reduced. Thus, the force needed to push the water stoppage valve is significantly reduced because the user only needs to approximately overcome the elastic force of the reset spring 33, which ensures the water stoppage operating hand feel.

With the above-mentioned configuration, switching the water flowing mode and the water stoppage mode requires only a small force by the user, thus providing a good operating hand feel.

The multifunctional shower head provides that, when the dial button moves in the clockwise direction, the water stoppage fitting element moves away from the water stoppage switching component, the switching fitting element abuts against the cyclic switching component to drive the water diversion plate of the cyclic switching component to rotate so as to change the relative position of the water diversion plate and the water diversion body, causing connection to different outlets of the water diversion body, thus achieving the switching of the waterway.

When the dial button moves in the counter-clockwise direction, the switching fitting element moves away from the cyclic switching component, the water stoppage fitting element abuts against the water stoppage switching component to drive the water stoppage valve of the water stoppage switching component to close the high-volume water inlet 2, and the low volume water inlet has water flowing through it thus achieving a low volume water stoppage or a full water stoppage.

Since the water stoppage fitting element and the switching fitting element are independent without influence, the outlet function switch and the low volume water stoppage do not conflict, so that the structure and the operating stability are better. This kind of shower head has a new switching mode which only requires a single hand to achieve cyclic switching and water stoppage switching so that the switching structure is stable and reliable, and the switching hand feel is better.

Although the present invention has been described with reference to the preferred embodiments thereof for carrying out the invention, it is apparent to those skilled in the art that a variety of modifications and changes may be made without departing from the scope of the invention which is intended to be defined by the appended claims.

The invention claimed is:

1. A multifunctional shower head, comprising:

a shower head main body including a high-volume water inlet;

a dial button protruding from the shower head main body;

a switching fitting and a water stoppage fitting respectively linked to the dial button;

a cyclic switch including a water diversion plate and a water diversion body having at least two outlets; and a water stoppage switch-including a water stoppage valve, wherein, when the dial button rotates in a first direction, the water stoppage fitting moves away from the water stoppage switch, and the switching fitting abuts against the cyclic switch, thus driving the water diversion plate of the cyclic switch to rotate to change the relative position of the water diversion plate and the water diversion body, so that a different outlet of the at least two outlets of the water diversion body is connected to achieve waterway switching, wherein, when the dial button rotates in a second direction, the switching fitting moves away from the cyclic switch, and the water stoppage fitting abuts against the water stoppage switch to drive the water stoppage valve of the water stoppage switch to close the high-volume water inlet to achieve water stoppage, and wherein the switching fitting and the water stoppage fitting are two independent parts, so that water pressure due to water stoppage fully acts on the water stoppage fitting and on the water stoppage switch.

2. The multifunctional shower head according to claim 1, wherein the switching fitting is a one-way driving pawl coaxially linked to the dial button.

3. The multifunctional shower head according to claim 2, wherein the cyclic switch is disposed with a driving pawl seat sleeved on the one-way driving pawl, and the dial button has an internal periphery disposed with a protruding block fitted to the one-way driving pawl, wherein, when the dial button rotates in the first direction, the protruding block abuts against the one-way driving pawl to drive the one-way driving pawl to rotate, and wherein, when the dial button rotates in the second direction, the protruding block rotates to move away from the one-way driving pawl, thus releasing the abutting and fitting relationship of the one-way driving pawl and the protruding block.

4. The multifunctional shower head according to claim 3, wherein the cyclic switch is further disposed with an-intermittent driver that drives the water diversion plate to intermittently rotate in one direction, one end of the intermittent driver being fixedly connected to the driving pawl seat, and another end of the intermittent driver being connected to the water diversion plate.

5. The multifunctional shower head according to claim 4, wherein the intermittent driver is disposed with a switching pawl and a ratchet wheel sleeved on the switching pawl, the ratchet wheel having an internal periphery that is disposed with a plurality of internal ratchets coupling to the switching pawl so that, when the switching pawl rotates in a direction to abut against one internal ratchet of the plurality of internal ratchets, the ratchet wheel rotates a certain angle corresponding to the one internal ratchet.

6. The multifunctional shower head according to claim 5, wherein the ratchet wheel has an external periphery that is disposed with a plurality of external ratchets having a size equal to that of the plurality of internal ratchets and having an opposite direction to that of the plurality of internal ratchets, and wherein a stoppage pawl is configured to abut against the plurality of external ratchets.

7. The multifunctional shower head according to claim 5, wherein the intermittent driver further comprises a switching pawl seat to hold the switching pawl, the switching pawl seat being fixedly connected to a tension spring so that, when the switching pawl rotates in a direction to abut against a pre-determined internal ratchet of the plurality of internal ratchets, the tension spring is pulled.

8. The multifunctional shower head according to claim 1, wherein the water stoppage fitting is a cam linked to the dial button.

9. The multifunctional shower head according to claim 8, wherein the water stoppage switch comprises a rotating block having a pivot and having a side that faces the cam which has an inclined surface, wherein, when the dial button rotates in the second direction, the cam rotates towards the rotating block, so that the cam abuts against the inclined surface to drive the rotating block to rotate about the pivot of the rotating block, and wherein the rotating block rotates to abut against the water stoppage valve to make the water stoppage valve move from a first position to a second position, so that the high-volume water inlet in the shower head main body is closed.

10. The multifunctional shower head according to claim 9, wherein the water stoppage valve has a valve body and is disposed with a low-volume water inlet with continuously flowing water, wherein a ring having a Y-shaped cross-section is disposed between the valve body of the water stop valve and an internal wall of the shower head main body, wherein, when the ring is disposed to face the low-volume water inlet of the water stoppage valve, water flows to the shower head main body through the low-volume water inlet to achieve a low-volume water stoppage, and wherein, when the ring is disposed opposite to the low-volume water inlet of the water stoppage valve, water is stopped by the ring after flowing through the low-volume water inlet to achieve a full water stoppage.

11. The multifunctional shower head according to claim 9, wherein the water stoppage valve is connected to a reset spring, so that when the abutting of the cam and the rotating block is released, the reset spring drives the water stoppage valve to reset to the first position from the second position.

* * * * *